United States Patent [19]

Schimko et al.

[11] Patent Number: 4,559,791

[45] Date of Patent: Dec. 24, 1985

[54] FLAT KNITTING MACHINE WITH SELECTIVE NEEDLE SELECTION

[75] Inventors: Reinhold Schimko; Werner Paul, both of Aalen-Wasseralfingen, Fed. Rep. of Germany

[73] Assignee: Universal Maschnenfabrik Dr. Rudolf Schieber GmbH & Co., KG, Wasseralfingen, Fed. Rep. of Germany

[21] Appl. No.: 668,250

[22] Filed: Nov. 5, 1984

[30] Foreign Application Priority Data

Nov. 7, 1983 [DE] Fed. Rep. of Germany ..... 3340197

[51] Int. Cl.[4] ..... D04B 7/00

[52] U.S. Cl. ..... 66/75.1; 66/78

[58] Field of Search ..... 66/75.1, 78, 75.2

[56] References Cited

U.S. PATENT DOCUMENTS

| | | | |
|---|---|---|---|
| 2,150,730 | 1/1937 | Schuessler | 66/77 |
| 4,413,482 | 11/1983 | Steiger | 66/75.1 |
| 4,470,274 | 9/1984 | Shima et al. | 66/75.1 |
| 4,490,994 | 1/1985 | Essig | 66/75.2 |

FOREIGN PATENT DOCUMENTS

| | | | |
|---|---|---|---|
| 2939066 | 4/1981 | Fed. Rep. of Germany | 66/75.1 |
| 878289 | 1/1943 | France | 66/75.1 |

*Primary Examiner*—Ronald Feldbaum

*Attorney, Agent, or Firm*—Sughrue, Mion, Zinn, Macpeak and Seas

[57] ABSTRACT

In a flat knitting machine with knitting needles which have flexible shanks and which are arranged in the needle channels of the needle beds, the flexible shanks of the knitting needles are each engaged from below in the region of an operating butt of the needle by a flexible shank of a Jacquard jack whose shank can be held either in an upper or in a lower position with respect to the needle bed. Selectively actuatable selection flaps are provided for selective extension of the Jacquard jacks into positions in which the needles can form stitches or tuck loops. In order to be able to withdraw the needles selectively to different withdrawn depths, the needles each have a further operating butt, additional withdrawal cam elements are provided on the knitting cam unit for engagement with the further operating butts, additional pressure cam elements are provided on the knitting cam unit in the region of the additional withdrawal cam elements to depress the first operating butts into the needle bed, and selectively actuatable selection flaps are provided for selective withdrawal of the Jacquard jacks into a position in which the first operating butts of the needles are not engageable by withdrawal cam elements.

6 Claims, 3 Drawing Figures

FLAT KNITTING MACHINE WITH SELECTIVE NEEDLE SELECTION

FIELD OF THE INVENTION

This invention relates to a flat knitting machine with knitting needles which have flexible shanks and which are arranged in the needle channels of the needle beds, wherein the flexible shanks of the knitting needles are each engaged from below, in the region of an operating butt of the knitting needle, by a likewise flexible shank of a Jacquard jack whose shank can be held either in an upper or in a lower position with respect to the needle bed, and wherein selectively actuatable selection flaps are provided for selective extension of the Jacquard jacks into positions in which the knitting needles can form stitches or tuck loops.

DESCRIPTION OF THE PRIOR ART

In known flat knitting machines of this type the needle selection of the knitting needles which are to produce stitches in the different fabric structure techniques is normally only concerned with the knitting needles which should be operative. One example of this is the three-path technique, in which those knitting needles are selected which in a row of knitting are to form stitches or tuck loops or which are to remain nonoperational, i.e. should not knit at all.

In combination fabric constructions, in which for example stitches and tuck loops are formed in one row of knitting, with the known flat knitting machines all the working needles are withdrawn by the same withdrawal cam element to a common established withdrawal depth. The size of the stitches and the size of the tuck loops is therefore always the same. However, it would be of advantage from a technical point of view if in this case the knitting needles could be withdrawn by different amounts. The knitting would thereby come to be more supple and attractive. Particularly in the case of the knitting of a nap fabric which consists of stitches and tuck loops and should be made with different amounts of withdrawal of the various knitting needles, the knitting needles forming tuck loops must be withdrawn to a lesser depth than the knitting needles forming stitches. However, there are also other fabric construction techniques in which the capability of withdrawing needles to different degrees during a row of knitting could be used with advantage; for example, when transferring, all the stitches to be transferred in the preceding row of knitting could be knitted somewhat more loosely and the stitches which are not to be transferred could be knitted with normal tightness.

SUMMARY OF THE INVENTION

It is an object of the present invention to provide a flat knitting machine of the type first referred to above in which it is possible selectively to withdraw the knitting needles to different depths, using a simple structure and simple operational movements.

This object is achieved in accordance with the present invention in that the knitting needles each comprise a further operating butt, additional withdrawal cam elements are provided on the knitting cam unit for engagement with the further operating butts, additional pressure cam elements are provided on the knitting cam unit in the region of the additional withdrawal cam elements and effective to depress the first operating butts into the needle bed, and selectively actuatable selection flaps are provided for selective withdrawal of the Jacquard jacks into a position in which the first operating butts of the knitting needles are not engageable by withdrawal cam elements.

With a simply constructed flat knitting machine made in this way, it is possible to withdraw any knitting needles, to be chosen by the additional selection flaps, starting from the level-cams position, to a withdrawn depth which is different from the normal preset withdrawal depth.

The additional pressure cam elements are preferably mounted on the leading side of and adjacent to the additional withdrawal cam elements and act on said additional operating butts.

Preferably, the construction of the flat knitting machine of the present invention is such that those knitting needles which are withdrawn by the additional withdrawal cam elements which engage against the additional operating butts are withdrawn less far than those needles which are withdrawn by the withdrawal cam elements which engage with the first operating butts.

All the withdrawal cam elements are preferably actuatable as desired at any position of reversal of the carriage.

In order to be able to operate in exactly the same for both directions of traverse of the machine carriage, the knitting cam units are preferably formed symmetrically with respect to the central transverse axis on which the selection flaps for the choice for the formation of tuck loops are arranged.

Preferably, several rows of selection flaps are provided, parallel to the direction of traverse of the cam unit, and selection butts on the Jacquard jacks are arranged in a staggered array in a corresponding number of rows.

BRIEF DESCRIPTION OF THE DRAWINGS

The invention will now be described in more detail with reference to an embodiment which is shown by way of example in the accompanying drawings. In the drawings.

DESCRIPTION OF THE PREFERRED EMBODIMENT

Figure 3:
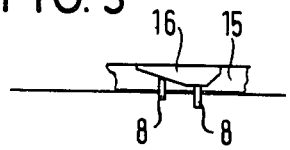
Figure 1:
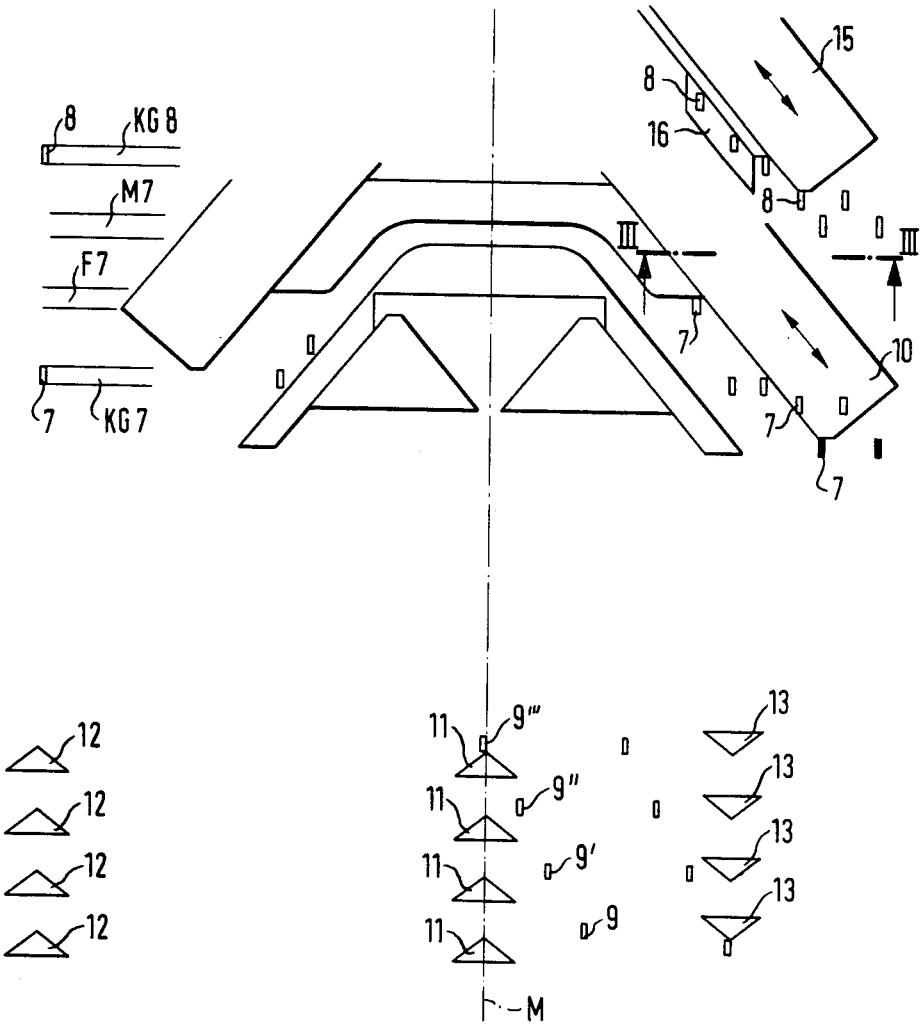
FIG. 1 is a schematic plan view of a knitting cam unit of a flat knitting machine in accordance with the invention, the machine being only partially shown.
Figure 2:
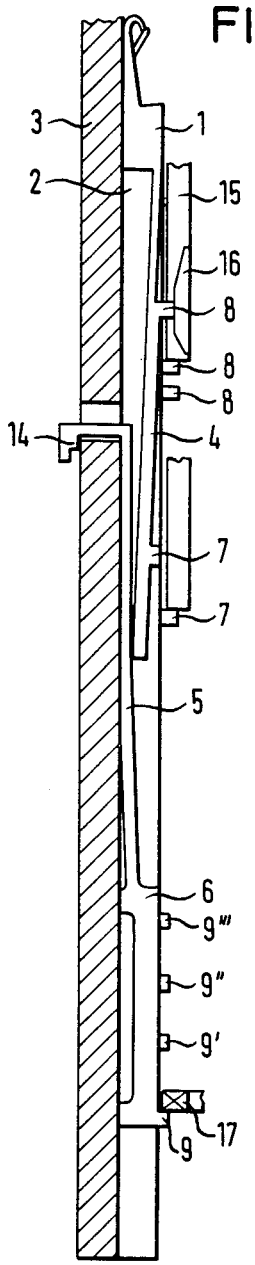
FIG. 2 is a sectional view through a needle bed of a flat knitting machine in accordance with the present invention, the section being taken along one needle channel; and, FIG. 3 is a partial view of an additional pressure cam element in the knitting cam unit of the flat knitting machine of the present invention.

In the flat knitting machine in accordance with the present invention, whose knitting tools and knitting cam unit are shown in the drawings, knitting needles 1 are arranged in needle channels 2 of a needle bed 3. The knitting needles 1 each comprise a rearwardly projecting flexible shank 4 which is engaged from below by a shank 5, which is likewise flexible, of a Jacquard jack 6. Each knitting needle 1 is provided with a first operating butt 7 in the region of the free end of its shank 4, and also with a second operating butt 8 in its central region. The Jacquard jacks 6 are provided in like manner with selection butts 9, which may be arranged in a staggered array as selection butts 9', 9'' and 9'''.

In the knitting cam unit there are provided cam elements (not shown) for guiding the knitting needles 1 by means of their first operating butts 7, during the formation of stitches and the formation of tuck loops. The withdrawal of the knitting needles 1 by the operating butts 7 for the formation of stitches or tuck loops is effected by a withdrawal cam element 10 which can be actuated as desired at the positions of carriage reversal.

Additionally, selection flaps 11 are arranged on the knitting cam unit on its central transverse axis M. These selection flaps 11 can be brought selectively into engagement with the selection butts 9, 9', 9'' and 9''' of the Jacquard jacks 6 in order to choose the knitting needles 1 for the formation of tuck loops. Preceding the selection flaps 11 there are provided selection flaps 12 which serve for the choice of the knitting needles 1 for the formation of stitches.

In addition to the selection flaps 11 and 12 there are provided further selection flaps 13 which, in like manner, can be selectively actuated in order to engage against the selection butts 9, 9', 9'' and 9''' of the Jacquard jacks 6 and to retract the chosen jacks into a position in which the flexible shank 5 of the Jacquard jack 6 is retained in a position where it is depressed in the needle channel 2. This retention is effected by means of a hooked nose 14 at the free end of the flexible shank 5 of the Jacquard jack 6.

In the knitting cam unit there is also provided an additional withdrawal cam element 15, which can likewise be actuated at the positions of carriage reversal. This withdrawal cam element 15 withdraws the knitting needles 1 by engaging with their second operating butts 8. On the advancing side of the 25 aforesaid additional withdrawal cam element 15 there is provided an additional pressure cam element 16 which, by engagement with the operating butts 8, enables the rearward operating butts 7 of the knitting needles 1 to be pushed down into the needle channel 2.

The tracks in which the first operating butts 7 of the knitting needles 1 are positioned at the stitch casting-off level, tuck casting-off level and level-cams level are indicated at M7, F7 and KG7 respectively, while the track in which the additional operating butts 8 of the knitting needles 1 are positioned in the level-cams position is indicated at KG8.

By means of the illustrated knitting cam unit the working knitting needles 1 can be withdrawn to different withdrawal depths by means of the optionally actuatable withdrawal cam elements 10 and 15. When operating the machine with the carriage moving in the direction from right to left as shown in the drawings, initially all the knitting needles 1 which should be functional are pressed into the needle channels 2 by a pressure cam element which is not shown. At this stage the Jacquard jacks 6 are pushed downwards by a withdrawal cam element 17. With further movement, selection flaps 12 selectively pick out those knitting needles 1 which are to form stitches, and selection flaps 11 selectively pick out those knitting needles 1 which are to form tuck loops. Upon this selection, the Jacquard jacks 6 appropriate for the knitting needles 1 which are to be brought into action are pushed upwards, whereby the flexible shanks 5 of those Jacquard jacks 6 spring from the needle channels 2 and consequently the needle butts 7 can bring the associated knitting needles 1 into operation.

If now the knitting needles 1 are extended to the stitch and tuck levels and are pushed down again in the withdrawal region to the tuck level, then the pressure cam element 16 presses the flexible shank 4 of the knitting needle 1, by way of the operating butt 8, sufficiently far into the needle bed 3 that operating butt 7 is removed from the sphere of influence of the cam and the Jacquard jack 6 with its flexible shank 5 has achieved the position where it is pressed into the needle bed 2. In this position the Jacquard jacks 6 of those knitting needles 1 which should not be withdrawn by the lower withdrawal cam element 10 are withdrawn with the help of the selectively controlled selection flaps 13, so that, these jacks are retained locked in the needle channels 2 by their hooked noses 14, and cannot spring back again after release by the corresponding pressure cam element. During this time all the working knitting needles 1 are brought by the withdrawal cam element 15 through the operating butts 8 to the level-cams position (KG8). The operating butts 7 which have not been chosen until this point now come into action and are engaged by the withdrawal cam element 10. Preferably, the withdrawal cam elements 10 and 15 are set up in such a way that withdrawal cam element 10 always withdraws the knitting needles 1 further than does withdrawal cam element 15. Both withdrawal cam elements 10 and 15 can be actuated as desired at each position of carriage reversal.

In the case of the nap pattern mentioned initially, the knitting needles 1 which are to form stitches are withdrawn by withdrawal cam element 10, and those needles which are to form tuck loops are withdrawn by withdrawal cam element 15.

We claim:

1. A flat knitting machine comprising:

(a) knitting needles with flexible shanks arranged in the needle channels of the needle beds, each needle having first and second operating butts;

(b) Jacquard jacks with flexible shanks adapted to be retained either in an upper or in a lower position with respect to the needle bed, the needle shanks being engageable from below by the Jacquard jack shanks in the region of the first operating butts;

(c) selectively actuatable selection flaps for selective extension of the Jacquard jacks into positions in which the knitting needles can form stitches or tuck loops;

(d) first withdrawal cam elements on a knitting cam unit arranged for engagement with said first operating butts;

(e) second withdrawal cam elements on said knitting cam unit arranged for engagement with said second operating butts;

(f) pressure cam elements on said knitting cam unit in the region of said second withdrawal cam elements and effective to depress said first operating butts into the needle bed;

(g) and further selectively actuatable selection flaps for selective withdrawal of the Jacquard jacks into a position in which said first operating butts of the needles are not engageable by said first withdrawal cam elements.

2. A flat knitting machine according to claim 1, in which said pressure cam elements are mounted on the leading side of and adjacent to said second withdrawal cam elements and act upon said second operating butts.

3. A flat knitting machine according to claim 1, in which the knitting needles which are withdrawn by said second withdrawal cam elements engaging with said second operating butts are withdrawn less far than those needles which are withdrawn by said first withdrawal cam elements engaging with said first operating butts.

4. A flat knitting machine according to claim 1, in which said first and second withdrawal cam elements are actuatable as desired at each position of reversal of the carriage of the knitting machine.

5. A flat knitting machine according to claim 1, in which the knitting cam unit is symmetrical with respect to its central transverse axis, and in which those of said selection flaps which are effective for the choice of needles to form tuck loops are positioned on said central transverse axis.

6. A flat knitting machine according to claim 1, with a plurality of rows of said selection flaps, extending parallel to the direction of traverse of the cam unit, said Jacquard jacks being provided with selection butts arranged in a staggered array in a corresponding number of rows.

* * * * *